US006793105B1

(12) United States Patent
Ouyoung

(10) Patent No.: US 6,793,105 B1
(45) Date of Patent: Sep. 21, 2004

(54) AUTOMATIC SOAP DISPENSING DEVICE

(75) Inventor: Scott Ouyoung, Taichung (TW)

(73) Assignee: Globe Union Industrial Corp., Taichung Export Processing Zone (TW)

( * ) Notice: Subject to any disclaimer, the term of this patent is extended or adjusted under 35 U.S.C. 154(b) by 0 days.

(21) Appl. No.: 10/445,227

(22) Filed: May 27, 2003

(51) Int. Cl.[7] ..... B67D 5/00

(52) U.S. Cl. ..... 222/504; 222/63; 222/181.1; 222/333

(58) Field of Search ..... 222/63, 180–182, 222/333, 504

(56) References Cited

U.S. PATENT DOCUMENTS 4,946,070 A * 8/1990 Albert et al. ..... 222/52
6,062,425 A * 5/2000 Brown et al. ..... 222/1
6,209,752 B1 * 4/2001 Mitchell et al. ..... 222/63

* cited by examiner

*Primary Examiner*—J. Casimer Jacyna
(74) *Attorney, Agent, or Firm*—Leong C. Lei

(57) ABSTRACT

An automatic soap dispensing device having a housing, battery box and a control box, characterized in that one side of the material-delivery cylinder is provided with a tubular material inlet portion, the top end of the material inlet portion passes through the battery box and exposes eternally, the material inlet portion is provided with a material inlet passage having a tapered diameter, a connection section is formed into a conic shape soap inlet, the other side of the material inlet cylinder is provided with a piston holding section with piston passage, the bottom section of the material inlet cylinder is a tapered diameter material delivery passage, the connection section is formed into a conic shape soap outlet and a large diameter hole is rotatably locked with an ejector with a through passage, the soap inlet and soap outlet are provided with a steel bead, the bottom section is resiliently urged to seal the soap inlet and outlet, the piston passage is provided with a piston, and the external end is pivotally connected to a gear module which is driven by the motor.

2 Claims, 6 Drawing Sheets

AUTOMATIC SOAP DISPENSING DEVICE

BACKGROUND OF THE INVENTION (a) Technical Field of the Invention

The present invention relates to soap dispensing device, and in particular, to a dispensing device which, by means of hand sensing without any contact of the hand, can automatically dispensing soap solution/lotion.

(b) Description of the Prior Art

Conventional soap-dispensing device is normally operated by way of pressing a button positioned on the housing of the device to dispense liquid soap or cream soap. This conventional device has the drawback of damaging the pressing button or a handle having the same function as a result of inappropriate force application to the button or the handle. Further, the handle or the button has to be physically touched or pressed and therefore it is not hygienic when such device is installed in a public location. Accordingly, it is an object of the present invention to provide an automatic soap dispensing device.

SUMMARY OF THE INVENTION

Accordingly, it is an object of the present invention to provide an automatic soap dispensing device having a housing, battery box and a control box, wherein the housing contains a material-delivery cylinder, a motor and a gear module and the battery box is located on the top portion of the housing and the control box is engaged at one lateral side of the housing. One side of the material-delivery cylinder is provided with a tubular material inlet portion and the top end of the material inlet portion passes through the battery box and is exposed externally, the material inlet portion is provided with a material inlet passage having a tapered diameter, a connection section is formed into a conic shape soap inlet, the other side of the material inlet cylinder is provided with a plug holding section with piston passage, and the bottom section of the material inlet cylinder is a tapered diameter material delivery passage, the connection section is formed into a conic shape soap outlet and a large diameter hole is rotatably locked with an ejector with a through passage, and the soap inlet and soap outlet are provided with steel bead, and the bottom section is resiliently urged to seal the soap inlet and outlet, and a piston passage is provided with a piston, and the external end is pivotally connected to a gear module driven by the motor.

A further object of the present invention is to provide an automatic soap dispensing device, wherein the battery box is provided with a through hole for the material inlet portion of the material delivery cylinder to pass through, and the top end of the material inlet portion is exposed externally and is connected to the material outlet of the soap storing box.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 2:
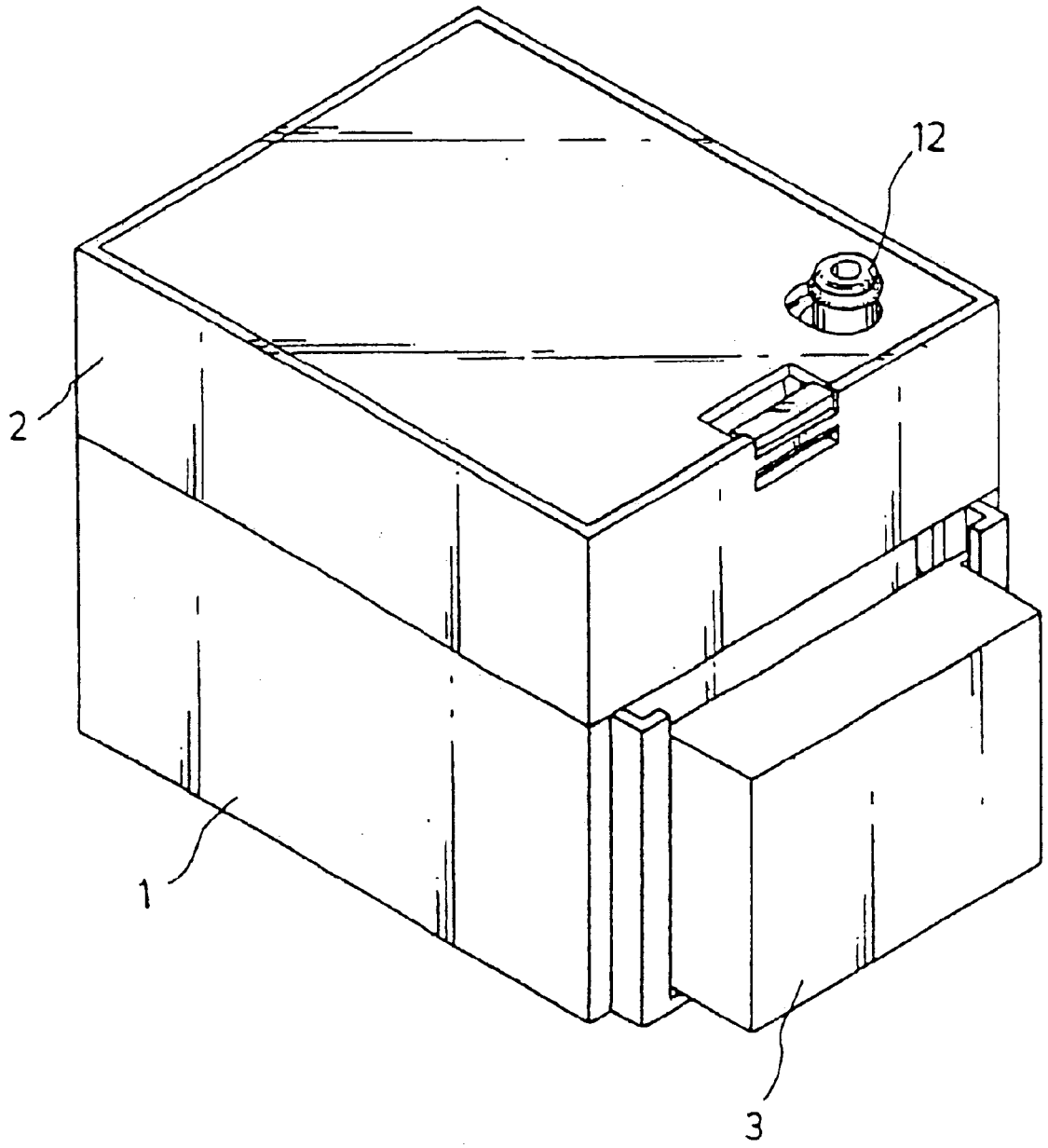
FIG. 2 is a perspective view of a soap dispensing device of the present invention.
Figure 6:
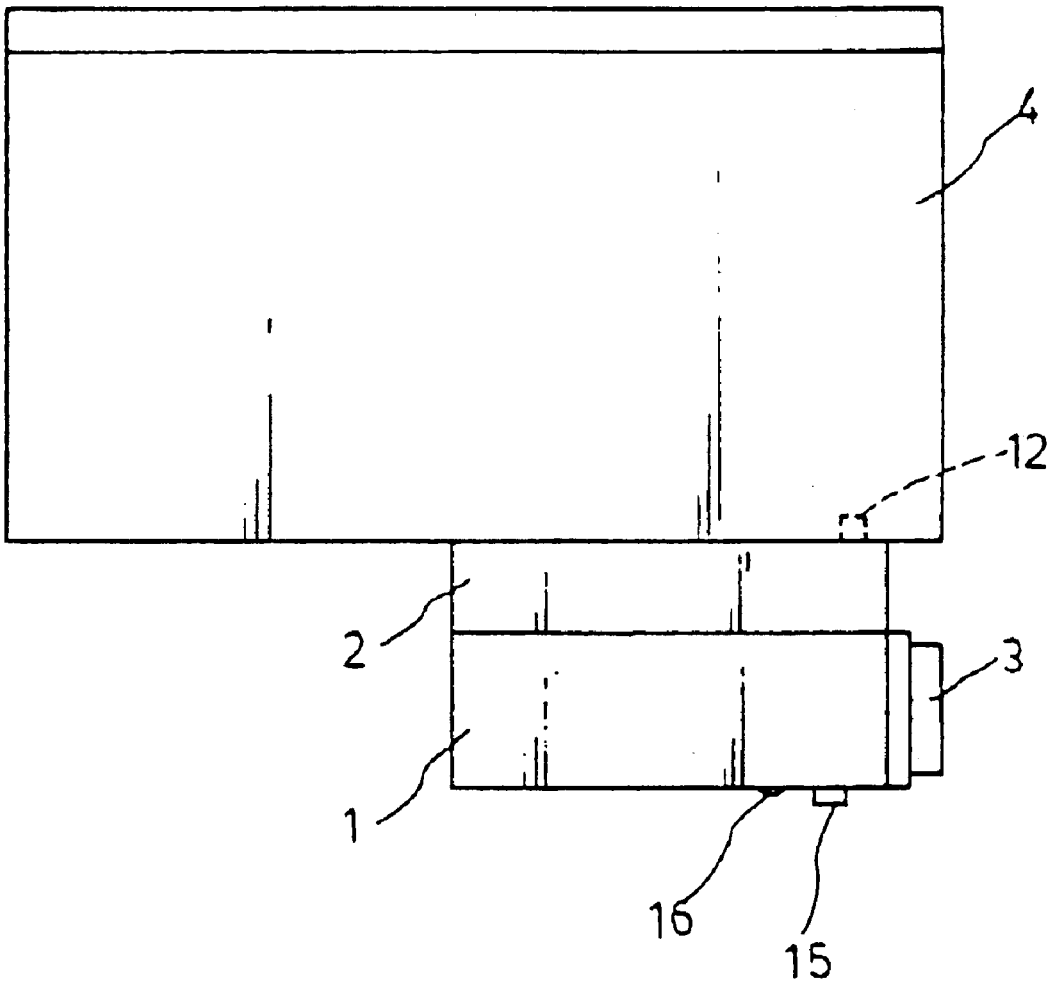
FIG. 6 is a schematic view showing the soap storing box of the present invention.

Referring to FIG. 2, there is shown an automatic soap-dispensing device having a housing 1, a battery box 2 and a control box 3. A material delivery cylinder 10, a motor 20 and gear module 30 are positioned within the housing 1. The top portion of the housing 1 is opened and the two walls of the housing 1 are provided with a fastening hole 1001. The two sides corresponding to the battery box 2 are provided with a fastening plate 2001. The battery box 2 can be stacked onto the top of the housing 1 and is fastened and engaged by the fastening plate 2001 with the fastening hole 1001. The top portion of the battery box 2 is covered by a box cover 21, and at a position on the battery box 2 corresponding to the box cover 21, a through hole 201 is provided. One lateral side of the housing 1 is provided with a pivot slot 1002 for connection with the control box 3. In accordance with the present invention, the soap-dispensing device is characterized in that the one lateral side of the material delivery cylinder 10 is provided with an elongated material inlet portion 12 which passes through the through hole 201 of the battery box and is insertably connected to the soap-storing box 4, as shown in FIG. 6.

The material inlet portion 12 is provided with a tapered material inlet passage 121, wherein the upper portion has a smaller diameter than the lower portion. At the joining position between the large and small diameter, a conic soap-inlet opening 122 is provided. The large diameter hole contains a steel bead 17, and a spring 18 such that the steel bead 17 is urged by the spring 18 to seal the soap-inlet opening 122. The other lateral side of the material delivery cylinder 10 is a piston-holding section 13 having a piston passage 131 to place a piston 11. The bottom section, at the same side as the piston-holding section, is a material-delivery passage 14 having a small upper diameter and a larger lower diameter.

Figure 1:
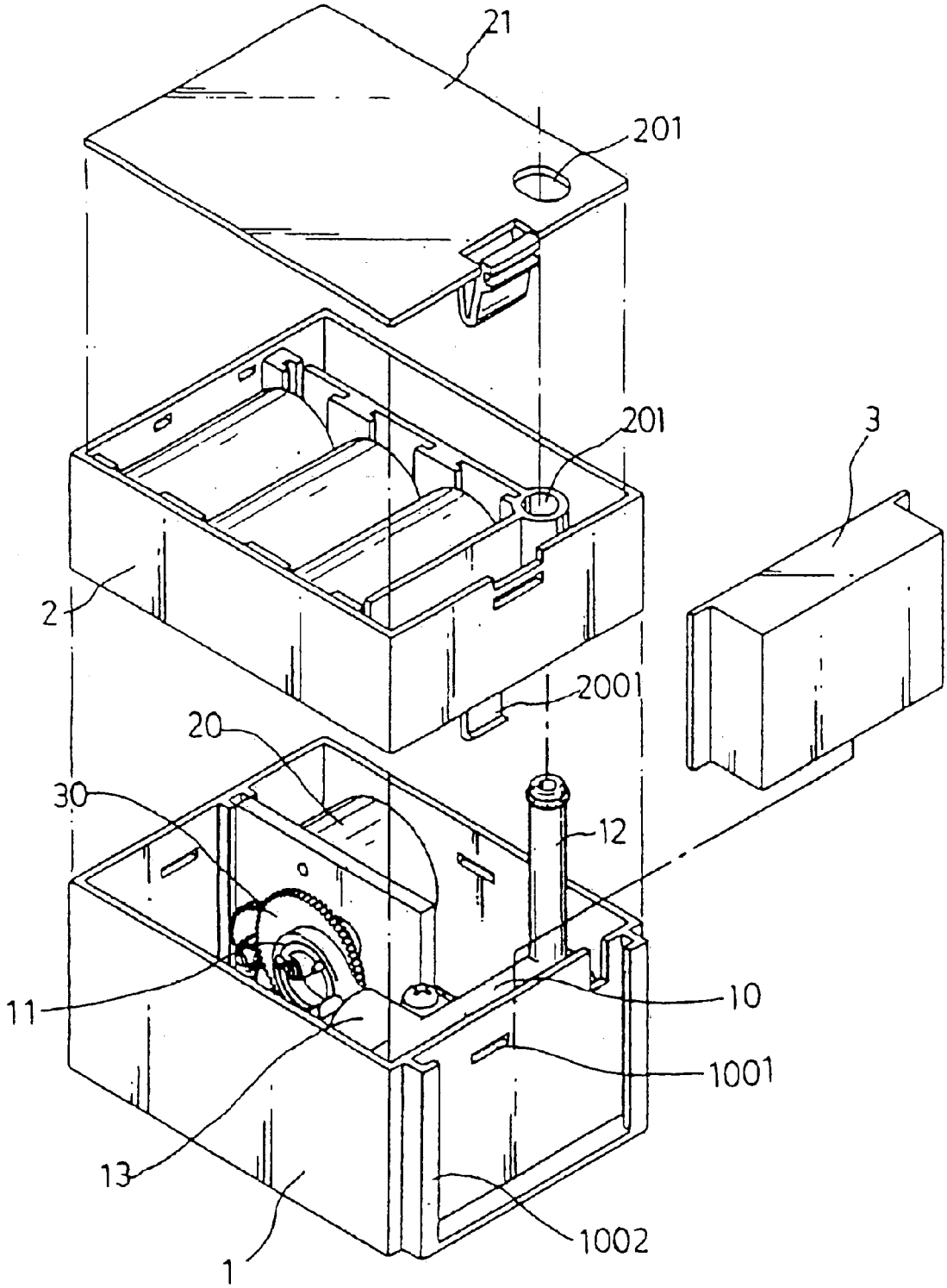
FIG. 1 is an exploded perspective view of a soap dispensing device of the present invention.

The opening of the passage 14 is rotatably locked with a material-delivery nozzle 15 having a through hole passage 151. The connection of the upper diameter and the lower diameter is a conic soap-delivery opening 141 and contains a steel bead 17 and a spring 18. The steel bead 17 is urged by the spring 18 to seal the soap-delivery opening 141. The material-delivery cylinder 1 0 has a horizontal inner tube passage 101 in communication with the piston hole passage 131 of the material inlet hole passage 121 and the material delivery hole passage 14 such that the individual passages within the material-delivery cylinder 10 are in communication with each other. The piston hole passage 131 of the piston-holding section 13 is provided with a piston 11, and the external end of the piston is pivotally connected to the gear module 30 and is driven by the gear module 30. The gear module 30 is pivotally connected to the motor 20 and is driven by the motor 20, as shown in FIG. 1.

Figure 3:
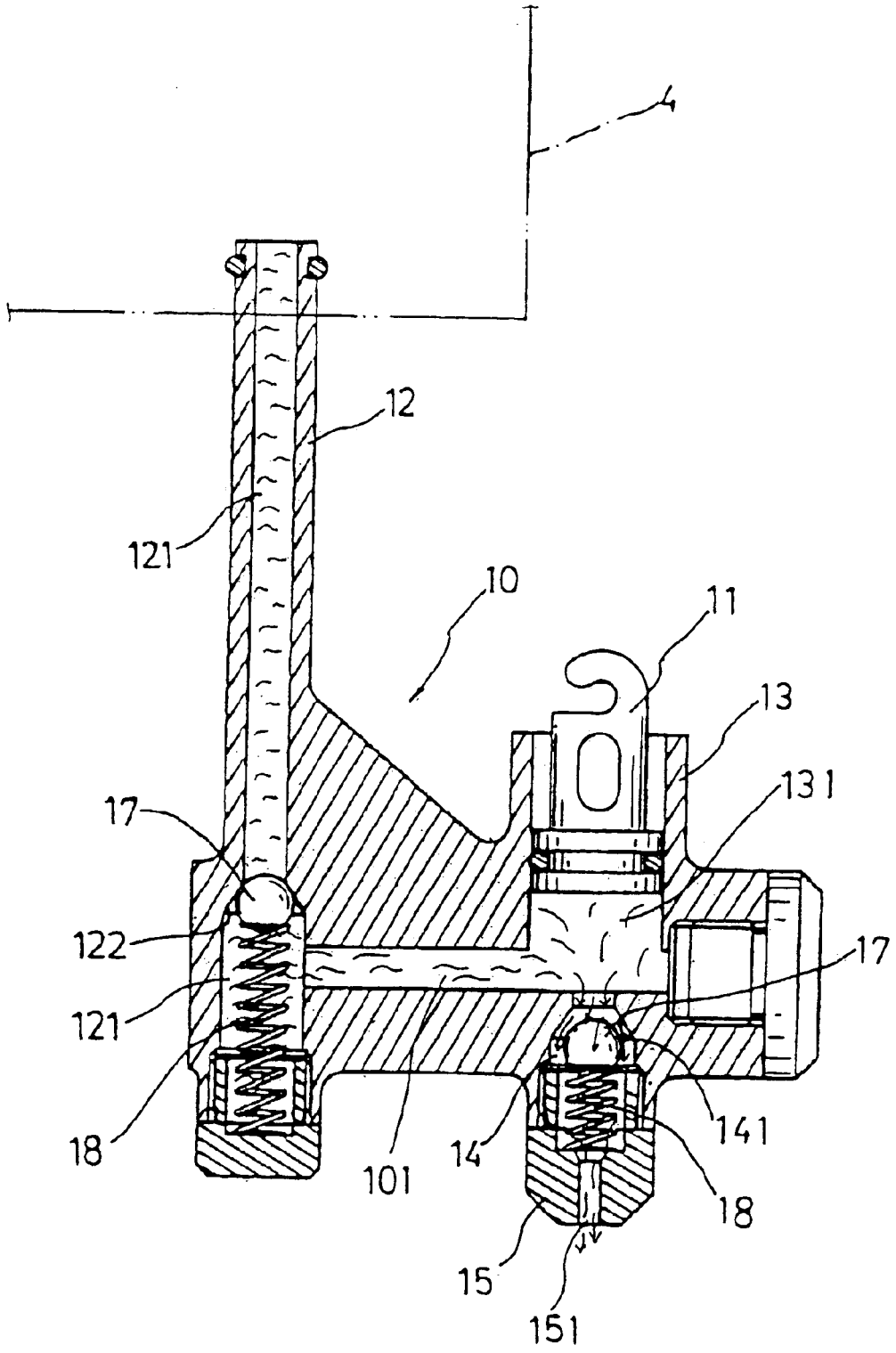
FIGS. 3, 4 and 5 show the material-delivery structure and the movement thereof in accordance with the present invention.
Figure 4:
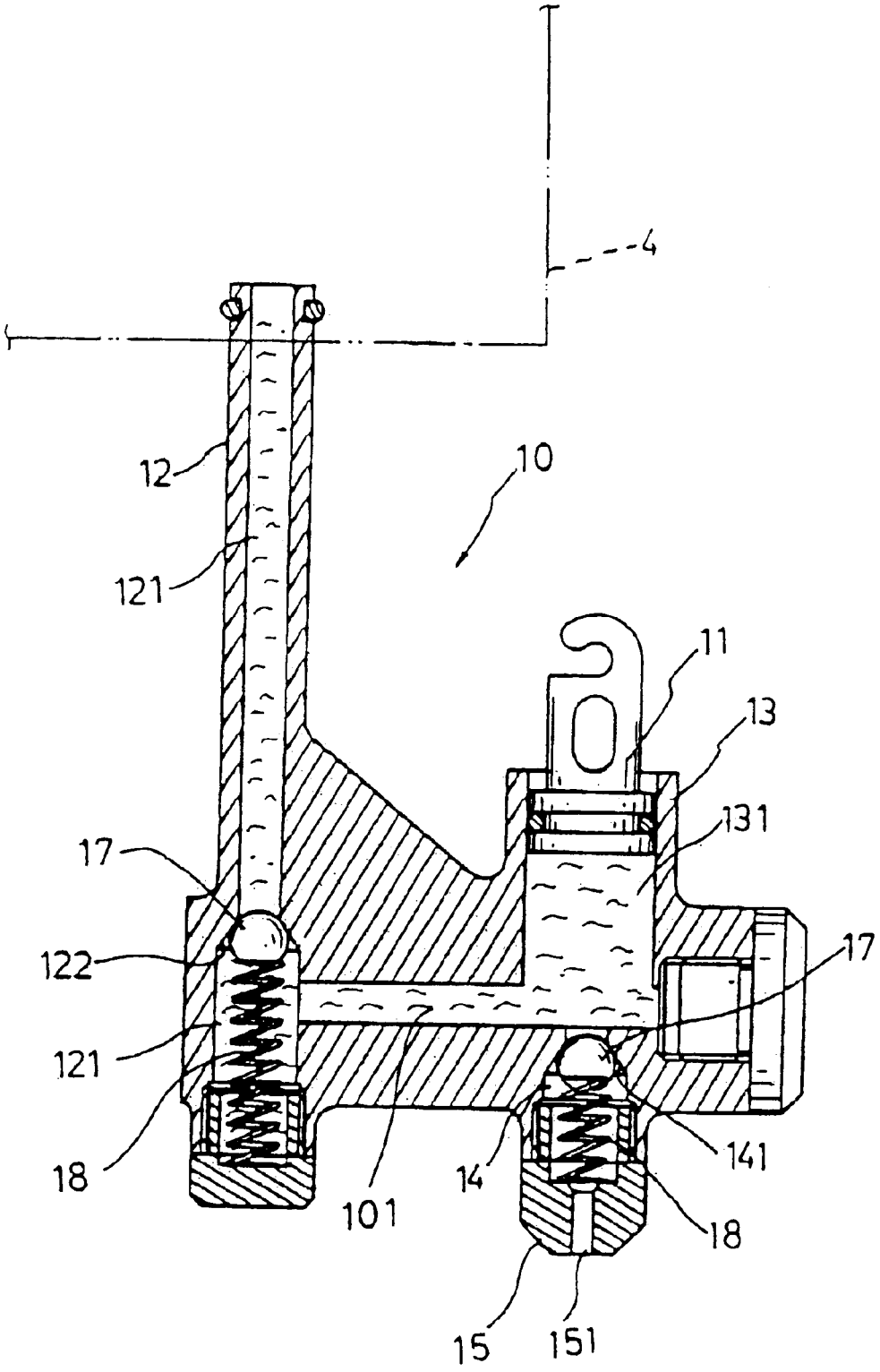
Figure 5:
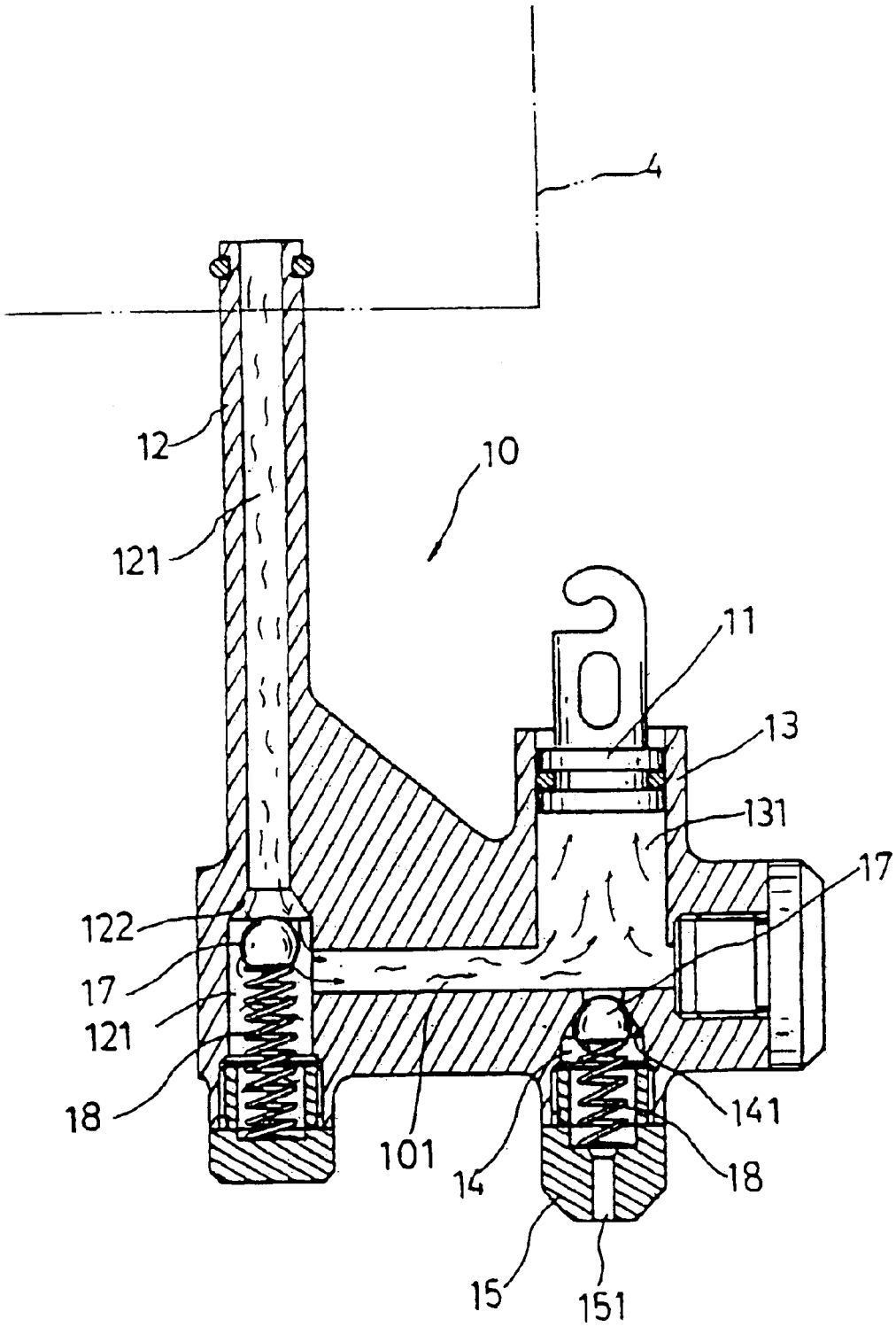

The operation of the soap-dispensing device is shown in FIGS. 3 to 5, and FIG. 6. After the housing 1, the battery box 2 and the control box 3 are connected and their circuits (not shown) are mounted, the combination is connected to the bottom section of the soap-storing box 4, and the material inlet section 12 is inserted to the material-delivery opening of the soap-storing box 4. The bottom section of the housing 1, near to the material-delivery nozzle 15, a sensor 16 is mounted to sense the entering of the hand of the user at the lower position of the material delivery nozzle 15, and the control box 3 activates the motor 20 to drive the gear module 30 so as to drive the piston 11 to provide a reciprocating movement, and the main action of the soap-dispensing is the material-delivery cylinder 10. As shown in FIGS. 3 to 5, the piston-holding section 13 and the piston 11 are directed to a straight structure. As shown in FIG. 3, the soap-dispensing device is at a stationery state and the material inlet portion 12 of the material delivery cylinder 10 is closely inserted to the material dispensing opening of the soap-storing box 4, and the piston 11 is at the highest point of the piston hole passage 131. At the same time, the space of the material delivery cylinder 10 is filled with soap solution and the soap-entering opening 122 of the material inlet hole 121 and the soap-dispensing opening 141 of the material delivery hole passage 14 are sealed by the steel bead 17 such that the interior of the material delivery cylinder 10 becomes a vacuum state. As shown in FIG. 4, when the piston 10 moves downward by force, a squeezing force is generated, and the interior of the material delivery cylinder must release pressure so that a balanced pressure can be obtained.

As a result, the steel bead 17 at the soap-delivery opening 141 moves downward to press the spring 18 by the pressure and the bead 17 moves to open the soap-dispensing opening 141 and the soap solution is flowing out from the material delivery nozzle of the hole passage 151. When a balanced pressure is obtained, the spring 18 urges the steel bead 17 and seals the soap-delivery opening 141.

As shown in FIG. 5, when the force applied to the piston 11 is restored to move upward, a siphoning effect is generated, and the interior of the material delivery cylinder, as a result of siphoning effect, must increase pressure so that the pressure can be balanced. Thus, the pressure of the material inlet hole passage 121 at the external of the soap inlet opening 122 is larger than the pressure within the cylinder. Thus, the pressure causes the steel bead 17 of the soap inlet opening 122 to be pushed downward and the spring 18 opens the soap-entering opening 122 and the soap solution flows to the material delivery cylinder 10 so as to increase pressure when the pressure is at a balance state, the spring 18 urges the steel bead 17 back to the original position and the soap inlet opening 122 is sealed the second time.

In view of the structure of the present invention, by the combination of motor, gear module and material delivery cylinder, the piston is proceeded a reciprocating movement so that the soap-delivery and soap inlet operation are completed. The soap-dispensing device smoothly provides the function of the automatic soap delivery function.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modification, substitutions and changes in the forms and details of the device illustrated and in its operation can be made by those skilled in the art without departing in any way from the spirit of the present invention.

I claim:

1. An automatic soap dispensing device having a housing, battery box and a control box, wherein the housing contains a material-delivery cylinder, motor and gear module and the battery box is located on the top portion of the housing and the control box is engaged at one lateral side of the housing, characterized in that one side of the material-delivery cylinder is provided with a tubular material inlet portion, the top end of the material inlet portion passes through the battery box and exposes externally, the material inlet portion is provided with a material inlet passage having a tapered diameter, a connection section is formed into a conic shape soap inlet, the other side of the material inlet cylinder is provided with a piston holding section with piston passage, the bottom section of the material inlet cylinder is a tapered diameter material delivery passage, the connection section is formed into a conic shape soap outlet, a large diameter hole is rotatably locked with an ejector with a through passage, and the soap inlet and soap outlet are provided with a steel bead, the bottom section is resiliently urged to seal the soap inlet and outlet, the piston passage is provided with a piston, and the external end is pivotally connected to a gear module which is driven by the motor.

2. The automatic soap dispensing device of claim 1, wherein the battery box is provided with a through hole for the material inlet portion of the material delivery cylinder to pass through, and the top end of the material inlet portion is exposed externally and connected to the material outlet of the soap storing box.

* * * * *